US009546664B2

(12) United States Patent
Hsu et al.

(10) Patent No.: US 9,546,664 B2
(45) Date of Patent: Jan. 17, 2017

(54) FAN SYSTEM

(71) Applicant: Wistron Corporation, New Taipei (TW)

(72) Inventors: Chia-Lung Hsu, New Taipei (TW); Po-Cheng Chen, New Taipei (TW); Ming-Chi Kao, New Taipei (TW); Ming-Chih Chen, New Taipei (TW)

(73) Assignee: Wistron Corporation, New Taipei (TW)

( * ) Notice: Subject to any disclaimer, the term of this patent is extended or adjusted under 35 U.S.C. 154(b) by 762 days.

(21) Appl. No.: 14/034,565

(22) Filed: Sep. 24, 2013

(65) Prior Publication Data

US 2014/0308128 A1 Oct. 16, 2014

(30) Foreign Application Priority Data

Apr. 15, 2013 (TW) ..... 102113305 A

(51) Int. Cl.

| | |
|---|---|
| ***F04D 29/058*** | (2006.01) |
| ***F04D 19/00*** | (2006.01) |
| ***F04D 25/06*** | (2006.01) |
| ***F04D 27/00*** | (2006.01) |
| ***F04D 29/052*** | (2006.01) |

(52) U.S. Cl.

CPC ..... *F04D 19/002* (2013.01); *F04D 25/0613* (2013.01); *F04D 27/008* (2013.01); *F04D 29/052* (2013.01); *F04D 29/058* (2013.01)

(58) Field of Classification Search

CPC .... F04D 19/00; F04D 19/002; F04D 25/0613; F04D 27/008; F04D 29/052; F04D 29/058

USPC ..... 415/129; 416/61; 310/67 R, 68 R, 90; 361/695, 678

See application file for complete search history.

(56) References Cited

U.S. PATENT DOCUMENTS

| | | | | |
|---|---|---|---|---|
| 5,500,952 | A * | 3/1996 | Keyes | A41D 13/018 2/465 |
| 5,636,377 | A * | 6/1997 | Wiener | A41D 13/015 2/2.5 |
| 6,567,268 | B1 * | 5/2003 | Hsieh | H02K 5/1675 310/90 |
| 7,145,275 | B2 * | 12/2006 | Yang | F16C 39/06 310/67 R |
| 7,305,316 | B2 * | 12/2007 | Frankel | H05K 7/20209 318/471 |

(Continued)

*Primary Examiner* — Ninh H Nguyen
*Assistant Examiner* — Aaron R Eastman
(74) *Attorney, Agent, or Firm* — Jianq Chyun IP Office

(57) ABSTRACT

A fan system suitable for an electronic device is provided. The fan system includes a fan module and a fan protecting module. The fan module includes a base and a fan blade assembly. The base is disposed at the electronic device and has a chamber. The fan blade assembly includes a fan blade and a shaft portion. The fan blade is fixed on the shaft portion. The shaft portion is rotatably contained in the chamber. The fan protecting module includes an electromagnetic component and an accelerometer. The electromagnetic component is disposed at a position adjacent to the shaft portion. The accelerometer is disposed in the electronic device and coupled to the electromagnetic component. When an acceleration of the electronic device detected by the accelerometer is greater than a threshold value, the electromagnetic component applies magnetic force to the shaft portion to prevent the shaft portion from overly shifting or deflecting.

13 Claims, 5 Drawing Sheets

100

(56) References Cited

U.S. PATENT DOCUMENTS

| | | | | |
|---|---|---|---|---|
| 7,922,446 | B2 * | 4/2011 | Bei | F04D 29/626 415/229 |
| 8,235,650 | B2 * | 8/2012 | Liang | F04D 29/051 384/446 |
| 2004/0183283 | A1 * | 9/2004 | Buckman | A41D 13/018 280/730.1 |
| 2006/0076827 | A1 * | 4/2006 | Albright | B60T 7/20 303/123 |
| 2008/0074010 | A1 * | 3/2008 | Jungmayr | F04D 29/058 310/67 R |
| 2008/0169733 | A1 * | 7/2008 | Lin | F04D 29/057 310/67 R |
| 2008/0238228 | A1 * | 10/2008 | Chang | F04D 29/058 310/90 |
| 2010/0080716 | A1 * | 4/2010 | Tsai | F04D 29/057 417/354 |
| 2010/0300648 | A1 * | 12/2010 | Grantham | H05K 7/20745 165/55 |
| 2011/0027075 | A1 * | 2/2011 | Nogami | F04D 25/0613 415/182.1 |

* cited by examiner

FAN SYSTEM

CROSS-REFERENCE TO RELATED APPLICATION

This application claims the priority benefit of Taiwan application serial no. 102113305, filed on Apr. 15, 2013. The entirety of the above-mentioned patent application is hereby incorporated by reference herein and made a part of this specification.

BACKGROUND

Field of the Application

The invention relates to a fan system, and more particularly, to a fan system with a fan protecting module.

Description of Related Art

In today's information explosion era, electronic products are widely used in people's daily life. Along with continuous development of electronic technology, various electronic products have continuously emerged. In terms of development and application of personal computers, desktop personal computers (desktop PC) are firstly developed. Nevertheless, the desktop personal computers have larger volumes and a disadvantage in inconvenient carrying, then portable electronic devices such as easy to carry notebook PCs and Tablet PCs are developed. Following the trend of light and thin the portable electronic device, number of components accommodated in a unit volume thereof also increases rapidly, and thus heat generated by a heat generating element must be effectively discharged to the outside through heat dissipating apparatus, so as to ensure the normal operation of the electronic device. Fan is one of the most used heat dissipating apparatus, which blows off or extracts out hot air near the heat generating element via the fan, so that the heat generated by the heat generating element may be carried away by the nearby air and thereby achieve a heat dissipation effect.

Generally, a fan blade assembly of the fan uses a shaft portion thereof as a center for performing rotation so as to generate airflow. In order to prevent the shaft portion of the fan blade assembly from overly contacting and scrubbing with other components during the rotation and influencing the normal operation thereof or producing noise, the shaft portion is usually not completely fixed in an axial direction and has a movable route. However, when a user accidentally drops the portable electronic device, the fan blade assembly may produce a deflection shifting due to the existence of the aforementioned route, and may even thereby impacting other components adjacent thereto and resulting in a damage to the fan.

FIG. 1 is a schematic diagram illustrating an impact being generated by a conventional fan blade assembly. Specifically, if the user accidentally drops the electronic device, then a fan blade assembly 114' within a fan module 110' is thereby subjected to an impact and bumps into components adjacent thereto, as shown in FIG. 1, thereby resulting in a damage to the fan module 110'. For example, positions at region R1 and region R2 in FIG. 1 may generate impacts to a fan blade assembly 114' and a coil 116', positions at region R3 and region R4 in FIG. 1 may generate impacts to a shaft portion 114*b*' and a bearing axis 119', and a position in region R5 in FIG. 1 generates impacts to a fan blade 114*a*' and a base 117'. The shaft portion 114*b*' may be bent due to the aforementioned impacts, and thereby influence the normal operation of the fan module 110'.

SUMMARY OF THE APPLICATION

The invention provides a fan system capable of preventing a fan blade assembly from bumping into components adjacent thereto due to dropping an electronic device.

The invention provides a fan system suitable for an electronic device. The fan system includes a fan module and a fan protecting module. The fan module includes a base and a fan blade assembly. The base is disposed at the electronic device and has a chamber. The fan blade assembly includes at least one fan blade and a shaft portion. An end of the fan blade is fixed at the shaft portion. The shaft portion is rotatably contained in the chamber, so that the fan blade assembly is adapted to rotate relative to the base around the shaft portion, and at least one first end of the shaft portion includes a material attractive to magnetic force. The fan protecting module includes an electromagnetic component and an accelerometer. The electromagnetic component is disposed at a position adjacent to the first end of the shaft portion. The accelerometer is disposed at the electronic device and coupled to the electromagnetic component. When the acceleration of the electronic device detected by the accelerometer is greater than a threshold value, the electromagnetic component generates a magnetic force applied to the first end of the shaft portion to prevent the shaft portion from overly shifting or deflecting.

The invention provides a fan system for an electronic device. The fan system includes a fan module and a fan protecting module. The fan module includes a base and a fan blade assembly. The base is disposed at the electronic device and has a chamber. The fan blade assembly includes at least one fan blade and a shaft portion, wherein an end of the at least one fan blade is fixed on the shaft portion, the shaft portion is rotatably contained in the chamber, so that the fan blade assembly is adapted to rotate in relative to the base around the shaft portion, and at least one first end of the shaft portion includes a material attractive to magnetic force. The fan protecting module includes an electromagnetic component disposed at a position adjacent to the first end of the shaft portion, and capable of receiving a signal corresponded to a dropping state and transmitted from the electronic device, so as to generate a magnetic force applied to the first end of the shaft portion to prevent the shaft portion from overly shifting or deflecting.

In view of the foregoing, the fan system of the invention has the accelerometer and the electromagnetic component. When the electronic device is being dropped, the accelerometer can detect an acceleration change of the electronic device and enable the fan protecting module to determine the electronic device is in a dropping state, and the electromagnetic component can accordingly generate the magnetic force to drive the shaft portion of the fan blade assembly to move and thereby leaning against the end surface of the base, so that the shaft portion is firmly fixed during the dropping of the electronic device. With this, the fan blade assembly and the shaft portion thereof may be prevented from bumping into the base or other components due to the dropping of the electronic device, and thus probability of damaging the fan module is lowered and durability of the fan module is enhanced.

In order to make the aforementioned and other features and advantages of the present application more comprehensible, several embodiments accompanied with figures are described in detail below.

BRIEF DESCRIPTION OF THE DRAWINGS

The accompanying drawings are included to provide a further understanding of the application, and are incorporated in and constitute a part of this specification. The drawings illustrate embodiments of the application and, together with the description, serve to explain the principles of the application.

DETAILED DESCRIPTION OF DISCLOSED EMBODIMENTS

Figure 1:
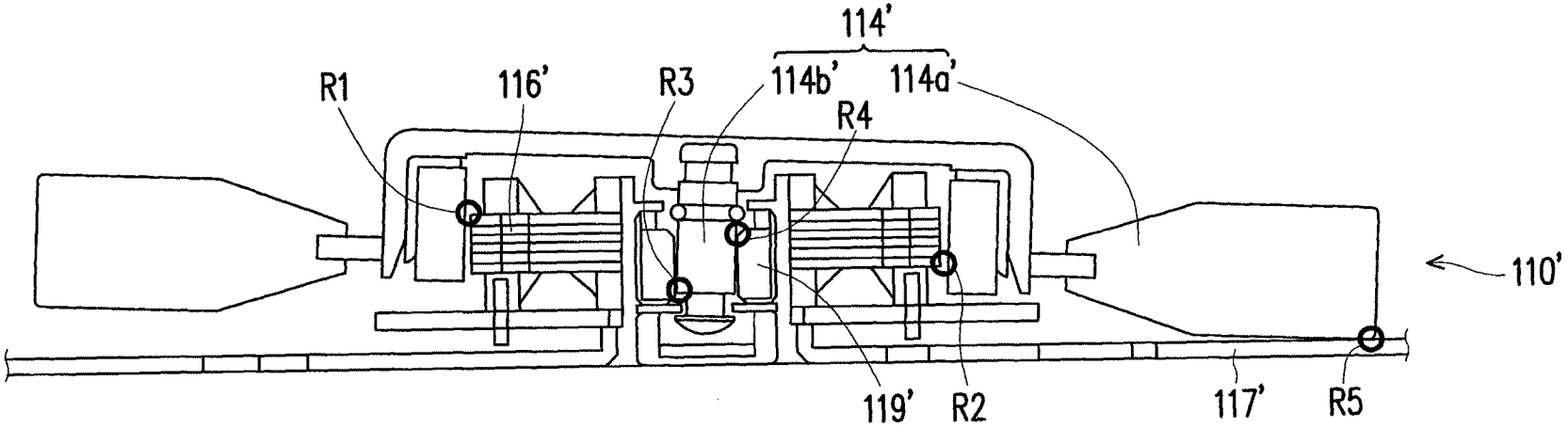
FIG. 1 (RELATED ART)
FIG. 1 is a schematic diagram illustrating an impact being generated by a conventional fan blade assembly.
Figure 2:
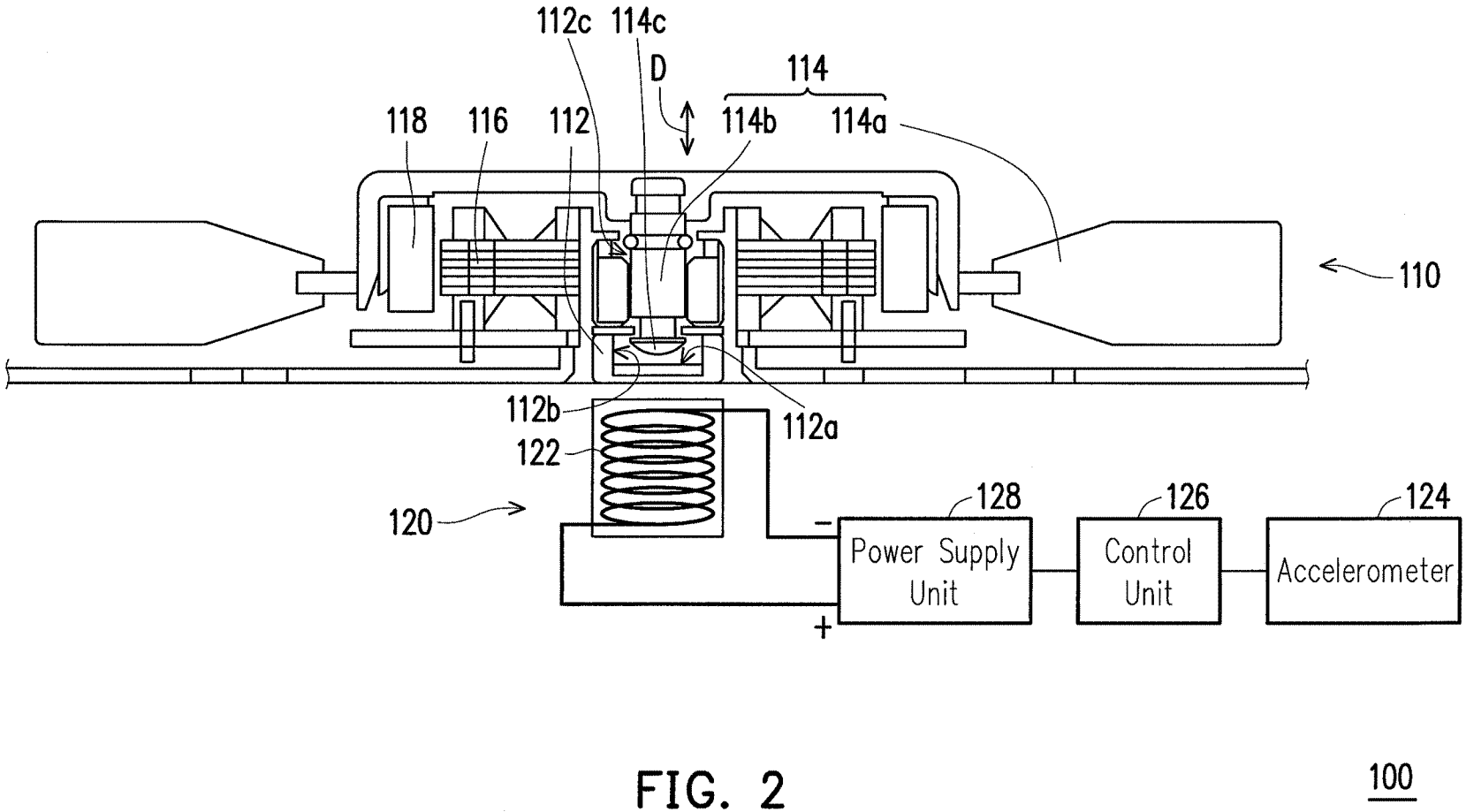
FIG. 2 is a schematic diagram illustrating a fan system according to an embodiment of the invention.
Figure 3:
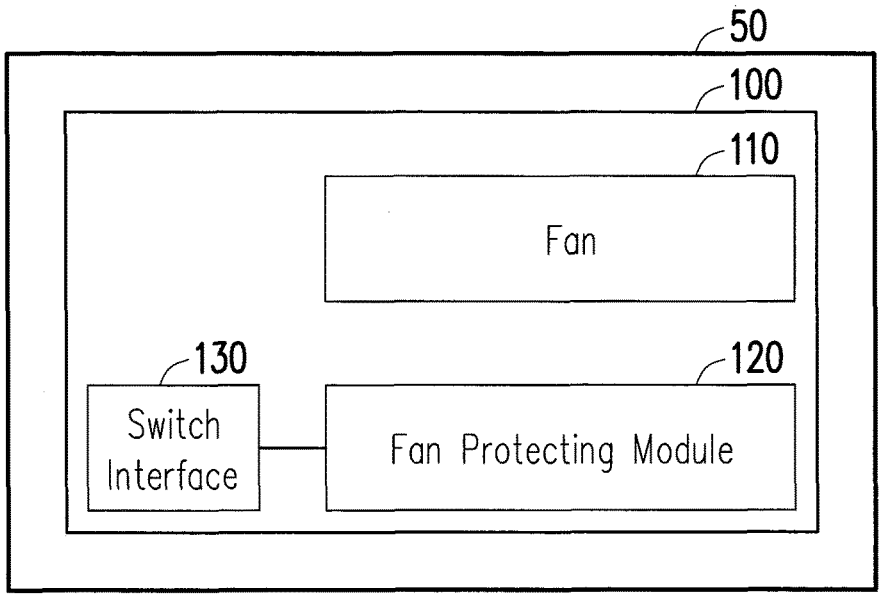
FIG. 3 is a schematic diagram illustrating an application of the fan system of FIG. 2 in an electronic device.

FIG. 2 is a schematic diagram illustrating a fan system according to an embodiment of the invention. FIG. 3 is a schematic diagram illustrating an application of the fan system of FIG. 2 in an electronic device. Referring to FIG. 2 and FIG. 3, a fan system 100 of the present embodiment is suitable for an electronic device 50, and the electronic device 50 is, for example, a notebook computer or other electronic device with cooling requirements. The fan system 100 includes a fan module 110 and a fan protecting module 120. The fan module 110 includes a base 112 and a fan blade assembly 114. The base 112 is disposed at the electronic device 50 and has a chamber 112*c*.

The fan blade assembly 114 includes multiple fan blades 114*a* and a shaft portion 114*b*. Each fan blade 114*a* is fixed at the shaft portion 114*b* with an end and forms a radial shape, and the shaft portion 114*b* is rotatably contained in the chamber 112*c* of the base 112. The fan blade assembly 114 is adapted to rotate relative to the base 112 around the shaft portion 114*b*. Furthermore, the fan module 110 has a coil 116 and a magnet 118, the coil 116 and the base 112 are fixed to each other and constitute a stator, the magnet 118 and the fan blade assembly 114 are fixed to each other and constitute a rotor. When the coil 116 is energized to generate a magnetic force, the stator and the rotor may rotate relative to each other via the magnetic force between the coil 116 and the magnet 118, so that the fan blade 114*a* generates a heat dissipation airflow for cooling the electronic device 50.

The fan protecting module 120 includes an electromagnetic component 122 and an accelerometer 124. The electromagnetic component 122 is, for example, a coil and disposed at a proper position adjacent to an end of the shaft portion 114*b*. The accelerometer 124 is disposed at the electronic device 50 depicted in FIG. 3 and coupled to the electromagnetic component 122. A material of the shaft portion 114*b* or at least one first end (e.g., a bottom end of the shaft portion 114*b*) of the shaft portion 114*b* includes a material attractive to magnetic force, such as metal or magnet. When the electromagnetic component 122 is energized, at least the bottom end of the shaft portion 114*b* can be attracted to the magnetic force generated by the electromagnetic component 122.

Figure 4:
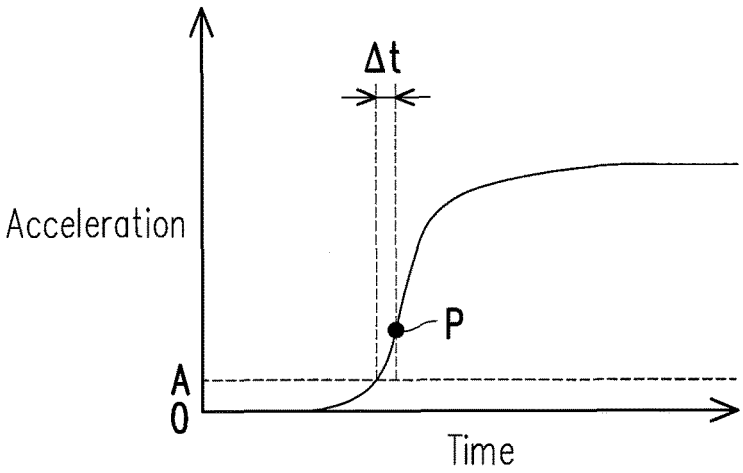
FIG. 4 is a schematic diagram illustrating an acceleration change of the electronic device of FIG. 3.
Figure 5:
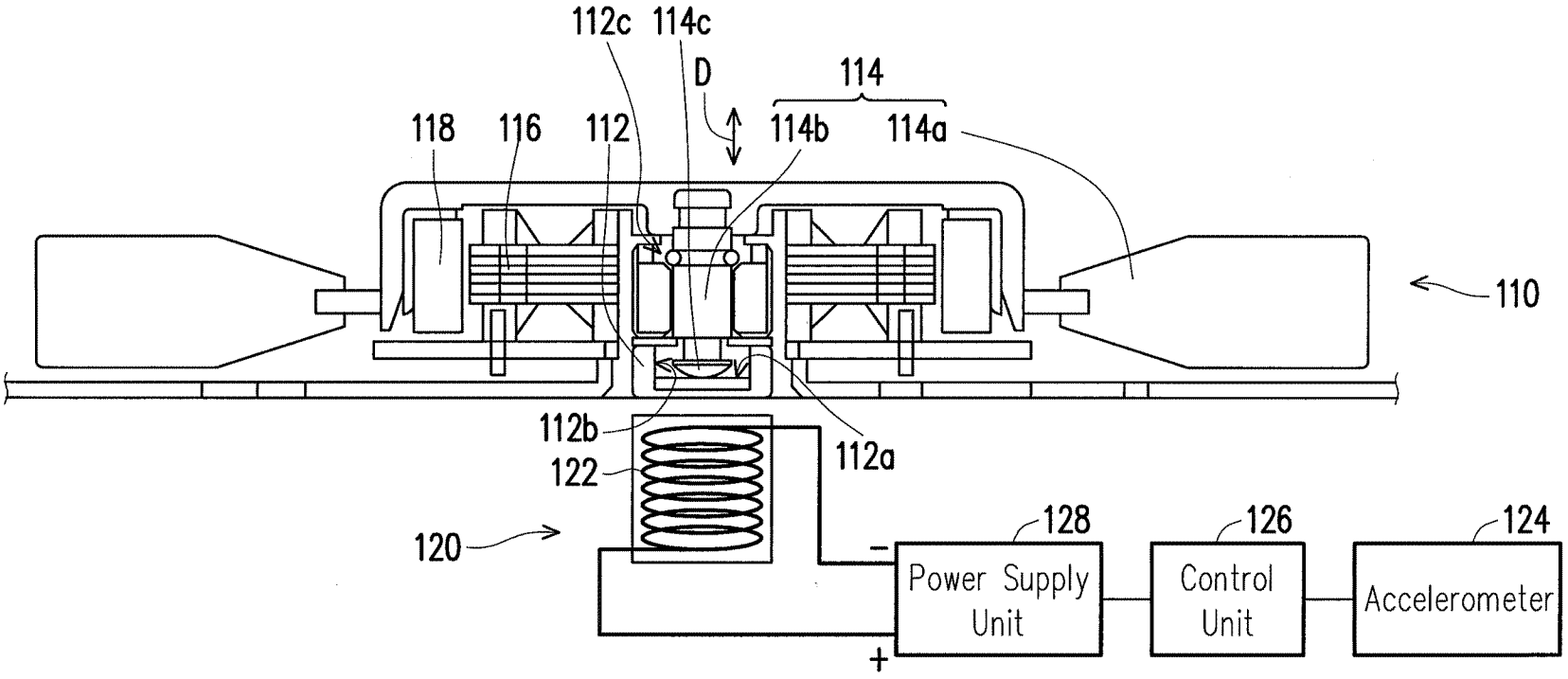
FIG. 5 is a schematic diagram illustrating an effect of a fan protecting module of FIG. 2.

FIG. 4 is a schematic diagram illustrating an acceleration change of the electronic device of FIG. 3. FIG. 5 is a schematic diagram illustrating an effect of a fan protecting module of FIG. 2. When a user accidentally drops the electronic device 50, an acceleration of the electronic device 50 in a direction perpendicular to the ground undergoes a change, as shown in FIG. 4, due to gravity effect. When the acceleration of the electronic device 50 detected by the accelerometer 124 is greater than a threshold value A shown in FIG. 4, the electromagnetic component 122 generates the magnetic force to drive the bottom end of the shaft portion 114*b*, as shown in FIG. 5, to instantly move towards the electromagnetic component 122 within the chamber 112*c* and lastly to be abutted against an end surface 112*a* of the chamber 112*c*, but in other embodiments, the bottom end of the shaft portion 114*b* may also not be abutted against the end surface 112*a* while maintaining a certain spacing so as to limit the movement via an interference produced by other structures of the shaft portion 114*b* and the corresponding structures of the base 112. After the electronic device 50 is dropped onto the ground and became static, the acceleration of the electronic device 50 detected by the accelerometer 124 to be 0 (smaller than the threshold value A), and then now the electromagnetic component 122 stops generating the magnetic force and enables the shaft portion 114*b* to return to a initial position. The value of the threshold value A may be changed or set according to the needs, and the invention is not limited thereto.

With a protective mechanism of the fan protecting module 120, when the electronic device 50 is being dropped, the accelerometer 124 can detect the acceleration change of electronic device 50 and enable the fan protecting module 120 to determine the electronic device 50 is in a dropping state, and the electromagnetic component 122 can accordingly generate the magnetic force to drive the shaft portion 114*b* of the fan blade assembly 114 to instantly move and to be abutted against the end surface 112*a* of the base 112, so that the shaft portion 114*b* is firmly fixed during the dropping of the electronic device 50 to be prevented from overly shifting, and in addition with the attraction of the magnetic force, the rotation of the shaft portion 114*b* may be kept on an axis thereof as far as possible without any deflection, so that the fan module 110 is protected. With this, the fan blade assembly 114 and the shaft portion 114*b* thereof may be prevented from bumping into the base 112 or other components due to the dropping of the electronic device 50, and thus probability of damaging the fan module 110 is lowered and durability of the fan module 110 is enhanced.

In the present embodiment, the protection mechanism of the fan protecting module 120 may further be set as the following. When the acceleration of the electronic device 50 detected by the accelerometer 124 is consistently greater than the threshold value A (viz. a time point marked by P in FIG. 4) within a predetermined length of time Δt shown in FIG. 4, the fan protecting module 120 begins to determine the electronic device 50 is in the dropping state, and then the electromagnetic component 122 generates the magnetic force to drive the shaft portion 114*b* of the fan blade assembly 114 to move and to be abutted against the end surface 112*a* of the base 112 with the bottom end of the shaft portion 114*b*. With this, the fan protecting module 120 may more accurately determine the electronic device 50 is in the dropping state, so as to prevent the fan protecting module 120 from false triggering the electromagnetic component 122 to drive the shaft portion 114*b* of the fan blade assembly 114 into action when the electronic device 50 is in a non-dropping state (e.g., when just shaking or moving the electronic device 50).

In the above-mentioned embodiment, the diagram shown in FIG. 4 is the acceleration change of the electronic device 50 (illustrate in FIG. 3) in the direction perpendicular to the ground during dropping, but the invention is not limited thereto. In other embodiments, the diagram shown in FIG. 4 may also be an acceleration change of the electronic device 50 in other directions. In other words, the accelerometer 124 may be configured to detect the acceleration of the electronic device 50 in other directions, so that when the electronic device 50 produces an acceleration change in each direction, the fan module 110 may be protected by the aforesaid protection mechanism of the fan protecting module 120.

Referring to FIG. 2 and FIG. 5, in the present embodiment, the fan blade 114*a* is fixed at a second end (e.g., a top end of the shaft portion 114*b*) opposite to the first end of the shaft portion 114*b*, and the bottom end of the shaft portion 114*b* faces toward the electromagnetic component 122. In other words, the fan blade 114*a* and the electromagnetic component 122 are respectively located at the two opposite sides of the shaft portion 114*b*, and thus the electromagnetic component 122 and the shaft portion 114*b* are not to be blocked by the fan blade 114*a*, such that the magnetic force generated by the electromagnetic component 122 can smoothly drive the shaft portion 114*b* into action. In other embodiments, the electromagnetic component 122 may be disposed at other suitable positions, and the invention is not limited thereto. In addition, in the present embodiment, the electromagnetic component 122 generates the magnetic attraction to attract the shaft portion 114*b* into action, but in other embodiments, the electromagnetic component 122 may be changed to generate a magnetic repulsion to push the shaft portion 114*b* into action (if the shaft portion or the bottom end of the shaft portion is a magnet).

In the present embodiment, the chamber 112*c* of the base 112 has a position limiting groove 112*b* therein, the shaft portion 114*b* has a position limiting structure 114*c* near the bottom end of the shaft portion 114*b*, and the position limiting structure 114*c* is position-limited within the position limiting groove 112*b* so as to prevent the fan blade assembly 114 from departing the base 112. In addition, in order to prevent the shaft portion 114*b* of the fan blade assembly 114 from overly contacting the peripheral wall of the chamber 112*c* during rotation and thereby influence the normal operation thereof or produce noise, a size of the position limiting groove 112*b* along a direction D has been designed as greater than a size of the position limiting structure 114*c* along the direction D, so that the position limiting structure 114*c* is not completely fixed in the direction D and has a movable route. The direction D is, for example, an axial direction of the shaft portion 114*b*, the end surface 112*a* of the chamber 112*c* is located within the position limiting groove 112*b* and perpendicular to the axial direction (direction D) of the shaft portion 114*b*. When the electronic device 50 is being dropped and triggers the protection mechanism of the fan protecting module 120, the magnetic force generated by the electromagnetic component 122 drives the position limiting structure 114*c* to move along the axial direction (direction D) of the shaft portion 114*b* and be abutted against the end surface 112*a* within the position limiting groove 112*b*, so as to firmly fix the shaft portion 114*b* and keep the center of rotation to be consistent with the axis without deflection, and thus prevent the fan blade assembly 114 from being overly shifted and deflected and thereby bumps into the components adjacent thereto due to an existence of the route of the position limiting structure 114*c* along the direction D.

As shown in FIG. 2 and FIG. 5, in the present embodiment, the fan protecting module 120 further includes a control unit 126 and a power supply unit 128. The power supply unit 128 is coupled to the electromagnetic component 122, the control unit 126 is coupled to the accelerometer 124 and the power supply unit 128. When the electronic device 50 is being dropped and triggers the protection mechanism of the fan protecting module 120, the control unit 126 receives a signal from the accelerometer 124 and controls the power supply unit 128 to supply power to the electromagnetic component 122, so that the electromagnetic component 122 generates the magnetic force to drive the shaft portion 114*b* into action. The control unit 126 is, for example, an embedded controller (EC), a keyboard controller (KBC) or other suitable types of control unit within the electronic device 50, and the invention is not limited thereto.

Figure 6:
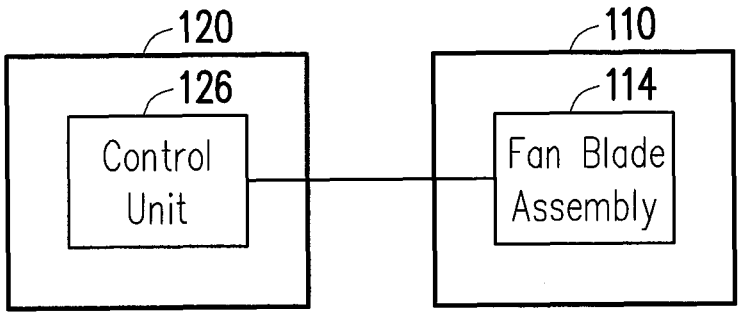
FIG. 6 is a schematic diagram illustrating parts of components of the fan system of FIG. 3 according to another embodiment.

FIG. 6 is a schematic diagram illustrating parts of components of the fan system of FIG. 3 according to another embodiment. Referring to FIG. 2 and FIG. 6, in the present embodiment, the control unit 126 of the fan protecting module 120 is further coupled to the fan blade assembly 114 and can control the fan blade assembly 114. Under a condition that the fan blade assembly 114 rotates in relative to the base 112 to provide the heat dissipation airflow, if the electronic device 50 is being dropped and causes the acceleration of the electronic device 50 detected by the accelerometer 124 is greater than the threshold value A (marked in FIG. 4), then the fan protecting module 120 not only triggers the protection mechanism, but also controls the fan blade assembly 114 to stop rotating via the control unit 126, so that the fan module 110 receives a more comprehensive protection. The action of controlling the fan blade assembly 114 to stop rotating may be performed within an extremely short period of time, which is at the same time or before, or even after the electromagnetic component 122 is being triggered.

The electronic device 50 of the present embodiment, for example, has a display surface (e.g., display screen of the notebook computer or display screen of the Tablet PC). When the fan protecting module 120 triggers the protection mechanism, the electronic device 50 may display a warning signal through the display surface thereof, so as to inform the user that the fan protecting module 120 is currently executing a fan protection work, such that the user can clearly know the operation status of the electronic device 50.

Referring to FIG. 3, in the present embodiment, the fan system 100 may include a switch interface 130. The switch interface 130 is configured to switch the fan protecting module 120 into a deactivated state or an activated state, so that the user is able to self choose to activate or deactivate the fan protecting module 120. Specifically, if the fan protecting module 120 shown in FIG. 2 is in the activated state and the acceleration of the electronic device 50 detected by the accelerometer is greater than the threshold value A shown in FIG. 4, then the electromagnetic component 122 generates the magnetic force. Otherwise, if the fan protecting module 120 is in the deactivated state and the acceleration of the electronic device 50 is greater than the threshold value A shown in FIG. 4, then the electromagnetic component 122 does not generate the magnetic force. The switch interface 130 is, for example, a physical button or push button disposed at the body of the electronic device 50, a menu displayed at the display surface of the electronic device 50, or other suitable forms, and the invention is not limited thereto.

In summary, the fan system of the invention has the accelerometer and the electromagnetic component. When the electronic device is being dropped, the accelerometer can detect the acceleration change of the electronic device and enable the fan protecting module to determine the electronic device is in a dropping state, and the electromagnetic component can accordingly generate the magnetic force to drive the shaft portion of the fan blade assembly to move to a proper position and maintain the stability of the axis, so that the shaft portion is firmly fixed during the dropping of the electronic device. With this, the fan blade assembly and the shaft portion thereof may be prevented from bumping into the base or other components due to the dropping of the electronic device, and thus the probability of damaging the fan module is lowered and the durability of the fan module is enhanced. In addition, the protection mechanism of the fan protecting module may further be configured as the following. When the acceleration of the electronic device detected by the accelerometer is consistently greater than the threshold value within a predetermined length of time, the fan protecting module begins to determine the electronic device is in the dropping state, and then the electromagnetic component generates the magnetic force. With this, the fan protecting module may more accurately determine whether the electronic device is in the dropping state, so as to prevent the fan protecting module from false triggering the electromagnetic component to drive the shaft portion of the fan blade assembly into action when the electronic device is in the non-dropping state.

It will be apparent to those skilled in the art that various modifications and variations can be made to the structure of the application without departing from the scope or spirit of the application. In view of the foregoing, it is intended that the application cover modifications and variations of this application provided they fall within the scope of the following claims and their equivalents.

What is claimed is:

1. A fan system suitable for an electronic device, the fan system comprising:

a fan module comprising:

a base disposed at the electronic device and having a chamber; and a fan blade assembly comprising at least one fan blade and a shaft portion, wherein an end of the at least one fan blade is fixed on the shaft portion, the shaft portion is rotatably contained in the chamber so that the fan blade assembly is adapted to rotate relative to the base around the shaft portion, and at least one first end of the shaft portion comprises a material attractive to magnetic force; and a fan protecting module comprising:

an electromagnetic component disposed at a position adjacent to the first end of the shaft portion and outside the chamber, wherein the electromagnetic component is located on a rotation axis of the shaft portion; and an accelerometer disposed in the electronic device and coupled to the electromagnetic component, wherein when an acceleration of the electronic device detected by the accelerometer is greater than a threshold value, the electromagnetic component generates a magnetic force applied to the first end of the shaft portion to prevent the shaft portion from overly shifting or deflecting.

2. The fan system as recited in claim 1, wherein the electromagnetic component generates the magnetic force to attract the shaft portion, so that the first end is abutted against an end surface of the chamber.

3. The fan system as recited in claim 2, wherein the chamber has a position limiting groove, the first end of the shaft portion has a position limiting structure, the position limiting structure is position-limited within the position limiting groove, the end surface is located within the position limiting groove, and the magnetic force generated by the electromagnetic component drives the position limiting structure to move and to be abutted against the end surface.

4. The fan system as recited in claim 3, wherein a size of the position limiting groove along a direction is greater than a size of the position limiting structure along the direction, and the position limiting structure is capable of moving along the direction so as to abut against the end surface.

5. The fan system as recited in claim 2, wherein the end surface is perpendicular to an axial direction of the shaft portion, the magnetic force generated by the electromagnetic component drives the first end of the shaft portion to move along the axial direction of the shaft portion and to be abutted against the end surface.

6. The fan system as recited in claim 1, wherein when the acceleration of the electronic device detected by the accelerometer is greater than the threshold value within a predetermined length of time, the electromagnetic component generates the magnetic force applied to the first end of the shaft portion to prevent the shaft portion from overly shifting or deflecting.

7. The fan system as recited in claim 1, wherein the at least one fan blade is fixed at a second end of the shaft portion that is opposite the first end.

8. The fan system as recited in claim 1, wherein the fan protecting module further comprises a control unit and a power supply unit, the power supply unit is coupled to the electromagnetic component, the control unit is coupled to the accelerometer and the power supply unit, and the control unit receives a signal from the accelerometer and controls the power supply unit to supply power to the electromagnetic component, so that the electromagnetic component generates the magnetic force.

9. The fan system as recited in claim 8, wherein the control unit is further coupled to the fan blade assembly and controls an operation thereof, when the fan blade assembly rotates and the acceleration of the electronic device detected by the accelerometer is greater than the threshold value, the control unit controls the fan blade assembly to stop rotating.

10. The fan system as recited in claim 1, wherein when the electromagnetic component generates the magnetic force applied to the shaft portion, the electronic device displays a warning message.

11. The fan system as recited in claim 1 further comprising a switch interface, wherein the switch interface is configured to switch the fan protecting module into a deactivated state or an activated state, when the fan protecting module is in the activated state and the acceleration of the electronic device detected by the accelerometer is greater than the threshold value, the electromagnetic component generates the magnetic force, and when the fan protecting module is in the deactivated state and the acceleration of the electronic device is greater than the threshold value, the electromagnetic component does not generate the magnetic force.

12. A fan system suitable for an electronic device, the fan system comprising:

a fan module comprising:

a base disposed at the electronic device and having a chamber; and a fan blade assembly comprising at least one fan blade and a shaft portion, wherein an end of the at least one fan blade is fixed on the shaft portion, the shaft portion is rotatably contained in the chamber so that the fan blade assembly is adapted to rotate relative to the base around the shaft portion, and at least one first end of the shaft portion comprises a material attractive to magnetic force; and a fan protecting module comprising:

an electromagnetic component disposed at a position adjacent to the first end of the shaft portion and outside the chamber, and capable of receiving a signal corresponding to a dropping state and transmitted from the electronic device, so as to generate a magnetic force applied to the first end of the shaft portion to prevent the shaft portion from overly shifting or deflecting, wherein the electromagnetic component is located on a rotation axis of the shaft portion.

13. The fan system as recited in claim 12, wherein the signal corresponding to the dropping state and transmitted from the electronic device comes from an accelerometer assembled on the electronic device, and the signal is being sent when an acceleration of the electronic device detected by the accelerometer is greater than a threshold value.

* * * * *